US006431916B1

(12) United States Patent
Asao

(10) Patent No.: US 6,431,916 B1
(45) Date of Patent: Aug. 13, 2002

(54) ELECTRICAL CONNECTOR

(75) Inventor: Kazuhiro Asao, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/818,867

(22) Filed: Mar. 28, 2001

(30) Foreign Application Priority Data

Mar. 28, 2000 (JP) ..... 2000-088133

(51) Int. Cl.[7] ..... H01R 13/66
(52) U.S. Cl. ..... 439/620
(58) Field of Search ..... 439/620, 607, 439/676, 84; 333/184

(56) References Cited

U.S. PATENT DOCUMENTS 4,187,481 A 2/1980 Boutros
5,647,768 A * 7/1997 Messuri et al. ..... 439/620
5,816,413 A * 10/1998 Beccabella et al. ..... 209/399
6,086,422 A * 7/2000 Glynn ..... 439/620
6,159,049 A * 12/2000 Schramme et al. ..... 439/620

FOREIGN PATENT DOCUMENTS

DE 44 14 533 A1 11/1994
EP 0 339 802 A2 11/1989
EP 0 969 568 A1 1/2000

* cited by examiner

*Primary Examiner*—Tho D. Ta
*Assistant Examiner*—Phuong Nguyen
(74) *Attorney, Agent, or Firm*—Oliff & Berridge, PLC

(57) ABSTRACT

An electrical connector has a housing and an electrical terminal mounted in the housing. An electrical noise-reducing member, which is a body of magnetic material, is carried on the terminal and has a through-hole through which the terminal extends. A stop member is secured on the terminal to abut the end of the magnetic member at which the terminal emerges from the through-hole. The stop member prevents the noise-reducing member from sliding along the terminal.

5 Claims, 4 Drawing Sheets

ELECTRICAL CONNECTOR

BACKGROUND OF THE INVENTION

1. Field of Invention

The present invention relates to an electrical connector and, more particularly, to an electrical connector having an electrical noise-reducing member. Such a connector is used, for example, in a vehicle, such as an automobile.

2. Description of Related Art

In a known electrical connector, to reduce high-frequency noise signals, such as "spikes", transmitted in a terminal fitting of the connector, the terminal fitting is inserted into a cylinder of ferromagnetic material which absorbs the noise signals. Such a connector is disclosed in EP-A-969568. As shown in present FIG. 5, this known connector 1 has a housing 2 made of synthetic resin and a cylindrical body of magnetic material 3 integrated with the housing 2 at the rear portion thereof by insert molding. A plurality of L-shaped terminal fittings 4 are mounted in the housing 2, with the rear portion of each terminal fitting 4 inserted into a through-hole 3A of the magnetic material 3 and extending from the rear of the housing 2. The body of magnetic material acts to reduce electrical noise in the terminal fitting 4.

However, because the housing 2 and the magnetic material 3 are formed by insert molding, a complicated molding die is needed for the housing 2 and the magnetic material 3. Thus, the manufacturing cost of the connector 1 is high. Alternatively, the body of magnetic material may be installed on the housing after moulding, an elastically deformable lance for locking the body to the housing being formed integrally with the housing by one-piece molding. However, a complicated molding die for the connector and the lance is also needed and thus the manufacturing cost of the connector is high.

SUMMARY OF THE INVENTION

It is an object of the present invention to provide an electrical connector having noise-reducing magnetic material which can be relatively simply installed on a terminal fitting.

The present invention provides an electrical connector comprising:

a housing;

an electrical terminal mounted in said housing;

a electrical noise-reducing member of magnetic material carried on the terminal and having a through-hole through which said terminal extends to reduce electrical noise in said terminal; and a stop member secured on said terminal and abutting an end of said noise-reducing member at which said terminal emerges from said through-hole, whereby the stop member impedes movement of the noise-reducing member along said terminal.

This form of connector avoids a need for forming the member of magnetic material integrally with the housing by insert molding or forming an elastically deformable lance integrally with the housing to lock the member to the housing. That is, the connector of the invention allows the member of magnetic material to be easily installed at the desired position.

The member of magnetic material may be cylindrical with the through-hole being parallel to the axis of the cylinder. Alternatively, the member of magnetic material may have a plurality of through-holes, so that it can be mounted on a plurality of adjacent terminals, with the stop member on at least one of the terminals.

Preferably, the stop member is at least partly made of an elastically deformable material and elastically grips the terminal. Therefore, the stop member can also be easily installed on the terminal. More preferably the stop member is of rubber.

The stop member may also have a through-hole, the diameter of the through-hole being smaller than the width of the terminal. The stop member is then installed by inserting the terminal into the through-hole of the stop member to deform the stop member elastically.

The noise-reducing member may be made of any suitable magnetic material, e.g. ferrite, known to the person skilled in the art.

BRIEF DESCRIPTION OF THE DRAWINGS

Embodiments of the invention will now be described by way of non-limitative example with reference to the accompanying drawings, in which.

DETAILED DESCRIPTION OF PREFERRED EMBODIMENTS

Figure 1:
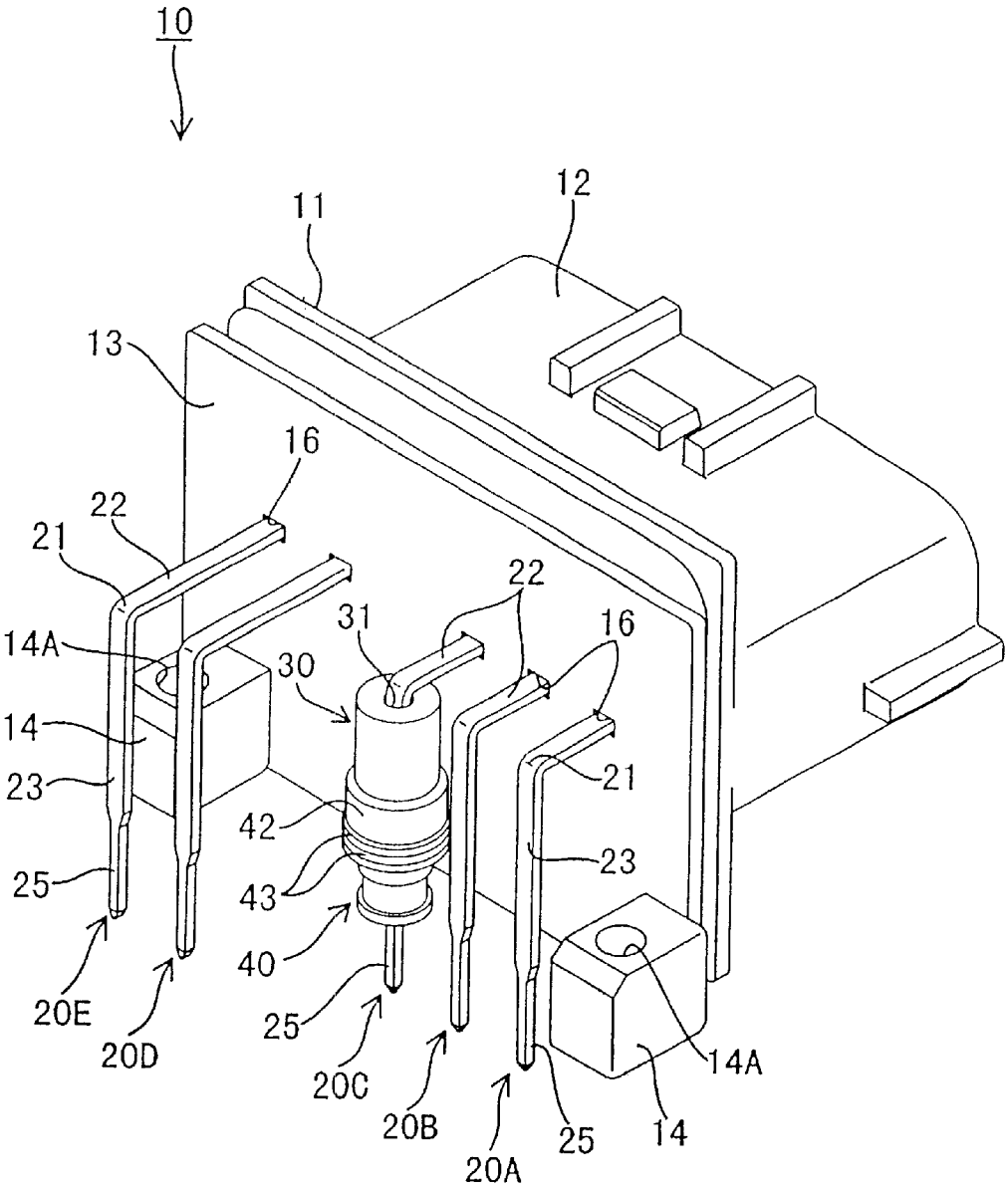
FIG. 1 is a perspective view showing an electrical connector which is an embodiment of the present invention.

As shown in FIG. 1, a connector embodying the invention has a housing 11 made of synthetic resin. A hood part 12 in which a mating connector (not shown) is fitted in use, is formed on the front side of the housing 11. A flat part 13 is formed on the rear side of the housing 11. A pair of box-shaped mounting portions 14 are located at the lower end of the rear side of the flat part 13. A screw hole 14A is formed in each mounting portion 14. The housing 11 can be secured to a substrate (not shown), e.g. a vehicle body, by screws inserted into each screw hole 14A, to fix the mounting portions 14 to the substrate. The housing 11 has five terminal press-fit holes 16. Each terminal press-fit hole 16 extends from the bottom surface of the hood part 12 to the rear surface of the flat part 13, with the terminal press-fit hole 16 penetrating through the flat part 13. Terminal fittings 20A–20E are pressed into the terminal press-fit holes 16 to penetrate into the hood part.

Each of the terminal fittings 20A–20E is formed of conductive metal sheet. The conductive metal sheet is bent in the shape of an "L" at a bend 21 to divide it into a horizontal part 22 and a vertical part 23. The terminal fittings 20A–20E all have the same construction except that the horizontal part 22 of each of the terminal fittings 20D and 20E is longer than that of each of the terminal fittings 20A–20C. A tab (not shown) is formed at the front end of the horizontal part 22. The tab projects into the hood part 12 and is connectable with a female terminal fitting (not shown) accommodated inside the mating connector which in use is fitted in the hood part 12. A projection (not shown) is formed widthwise at a base portion of the tab and pressed into the terminal press-fit hole 16 of the housing 11. A part of the horizontal part 22 projects from the flat part 13. The vertical part 23 extends downward from the bend 21. The lower end portion of the vertical part 23 is formed as a connection part 25 which has a smaller width than the vertical part 23 and which is connectable with a circuit mounted on a substrate (not shown).

An electrical noise-reducing body of magnetic material, herein called magnetic member 30, and a stop member 40 are installed on any one of the terminal fittings 20A–20E, the stop member preventing the magnetic member 30 from slipping off the terminal. In the embodiment, the magnetic member 30 and the stop member 40 are both installed on the terminal fitting 20C.

Figure 2:
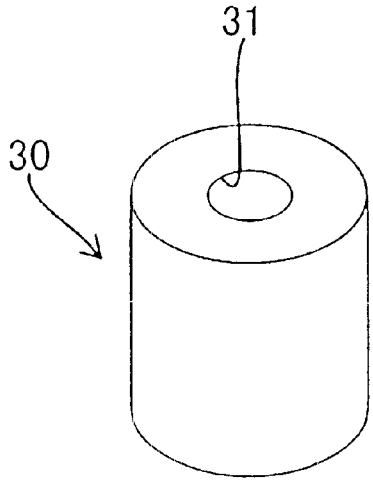
FIG. 2 is a perspective view showing a member of magnetic material for reducing electrical noise in the embodiment of FIG. 1.

As shown in FIG. 2, the magnetic member 30 in this embodiment is a cylinder made of a ferromagnetic material such as ferrite and has a through-hole 31. The inner diameter of the through-hole 31 is slightly larger than the width of the vertical part 23 of each of the terminal fittings 20A–20E so that the magnetic member 30 is slidable on the terminal fitting 20C, with the vertical part 23 inserted through the through-hole 31.

Figure 3:
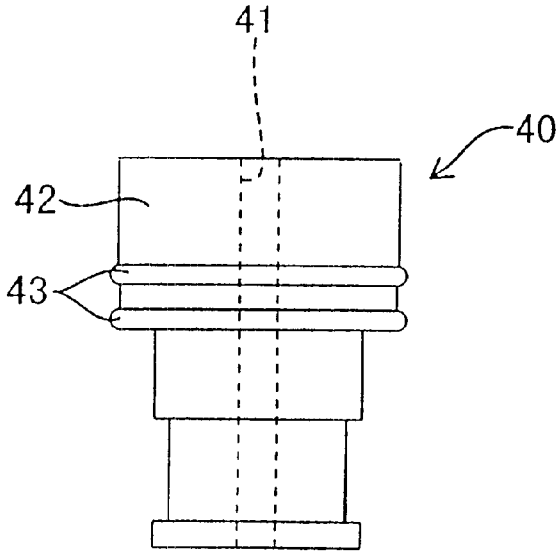
FIG. 3 is a side view showing a stop member of the embodiment of FIG. 1.

An elastic material such as rubber is used to mold the stop member 40. As shown in FIG. 3, the stop member 40 is cylindrical and has an installing hole 41 formed in the radial centre thereof such that the installing hole 41 extends through the stop member 40. The inner diameter of the installing hole 41 is slightly smaller than the width of the vertical part 23 of each of the terminal fittings 20A–20E so that the stop member 40 is fixed thereto elastically, when the vertical part 23 is press-fitted into the installing hole 41. A locking part 42 is formed at the upper part of the stop member 40. The outer diameter of the locking part 42 is a little larger than that of the lower part of the stop member 40. Two circumferential grip projections 43 are formed approximately axially midway along the cylindrical stop member 40 below the locking part 42. The outer diameter of each of the grip projections is larger than that of the locking part 42 to allow an operator to hold the stop member at the grip projections 43.

To assemble the connector 10 of the embodiment, after the housing 11 is formed by molding a suitable synthetic resin material, the terminal fittings 20A–20E are inserted into the terminal press-fit holes 16 respectively by press fitting before bending them at the bends 21. The terminal fittings 20A–20E projecting rearward from the housing 11 are bent downward at the bends 21 with a jig. In this manner, a molded semi-finished product having the housing 11 and the terminal fittings 20A–20E mounted thereon is obtained.

Then, the magnetic member 30 and the stop member 40 are installed on one of the terminal fittings (20C in the embodiment). First, the connection part 25 of the terminal fitting 20C is inserted into the through-hole 31 of the magnetic member 30. Then, the magnetic member 30 is slid upward on the vertical part 23 until it reaches the horizontal part 22 of the terminal fitting 20C. Next, the connection part 25 is press-fitted into the installing hole 41 of the stop member 40. The stop member 40 is then slid upward on the vertical part 23 to abut the magnetic member 30. The magnetic member 30 is thereby secured between the locking part 42 of the stop member 40 and the horizontal part 22 of the terminal fitting 20C, and movement along the vertical part 23 is prevented. The stop member 40 is held in place by elastically gripping the fitting 20C.

This completes the assembly of the connector 10. If, during use of the connection 10, electrical current flowing through the terminal fitting 20C includes high-frequency noise, the material of the magnetic member 30 absorbs the noise.

In this embodiment, after the terminal fitting 20C is inserted into the magnetic member 30, the stop member 40 is installed on the terminal fitting 20C at the end of the magnetic member 30 where the terminal fitting emerges from the magnetic member 30 to prevent the magnetic member 30 from slipping off the terminal fitting 20C. This construction eliminates the need for forming the magnetic portion integrally with the housing by insert molding or forming an elastically deformable lance integrally with the housing to lock the magnetic portion to the housing. Therefore, the molding die for the housing 11 can be simplified, which allows the manufacturing cost of the connector to be reduced.

The inner diameter of the through-hole 31 is set only slightly larger than the width of the vertical part 23 of each of the terminal fittings 20A–20E. Thus, the magnetic member 30 is radially located by inserting the vertical part 23 of any one of the terminal fittings 20A–20E into the through-hole 31 of the magnetic member 30 and is axially located by the stop member 40 and the horizontal part 22. Therefore, it is possible to prevent the magnetic member 30 from being shaken by vibrations applied to the connector 10 when the connector 10 is transported or used.

Further, the stop member 40 is made of elastic material such as rubber and elastically locked to any one of the terminal fittings 20A–20E by press-fitting the terminal fitting into the installing hole 41. Therefore, it is easy to install the components on the housing 11. The stop member 40 and the magnetic member 30 are removably installed on the terminal fittings 20A–20E. Thus, for example, the magnetic portion 30 may be initially installed on any one of the terminal fittings 20A–20E. The magnetic portion 30 can then be transferred to another of the terminal fittings 20A–20E selected at a later stage of fabrication, e.g. according to the noise-reducing requirement of a circuit. The initial installation and later fabrication may occur at different sites, and transporting the magnetic and stop members when carried on a terminal fitting is more convenient than transporting the magnetic member separately from the housing between the sites.

A typical application of the connector of the invention is in a DC circuit, such as in an automobile, e.g. in a radio power circuit.

The scope of the invention is not limited to the above-described embodiment, and the following embodiments are for example also included in the scope of the present invention.

(1) In the above-described embodiment, the connector 10, in use, is installed on a substrate. But the connector of the present invention is also applicable to other kinds of connectors. The shape of the terminal fitting is not limited to an "L"-shape.

(2) In the above-described embodiment, the terminal fittings 20A–20E are installed on the housing 11 by press-fitting a part thereof into the housing 11, but the terminal fitting may be installed thereon by other methods. For example, the terminal fitting may be formed integrally with the housing by insert molding.

(3) In the above-described embodiment, the magnetic member 30 is installed on only the terminal fitting 20C. But within the present invention, the magnetic member 30 may be installed on other terminal fittings. Further, as shown in FIG. 4, each of the terminal fittings 20A–20C may be inserted into each of a plurality of respective through-holes 36 of a noise-reducing magnetic material body 35, and one stop member 40 on one of the terminal fittings may prevent the body 35 from slipping off from the terminal fittings 20A–20C.

(4) In the above-described embodiment, the stop member 40 is a cylinder of circular cross-section into which any one of the terminal fittings 20A–20E can be inserted. But the shape of the stop member is not necessarily circularly cylindrical. For example, the stop member may be configured so as to laterally sandwich the terminal fitting at opposite sides thereof. The stop member is not necessarily required to immobilise the magnetic member but is required to prevent the magnetic member from unintentionally slipping off the terminal fitting.

Figure 4:
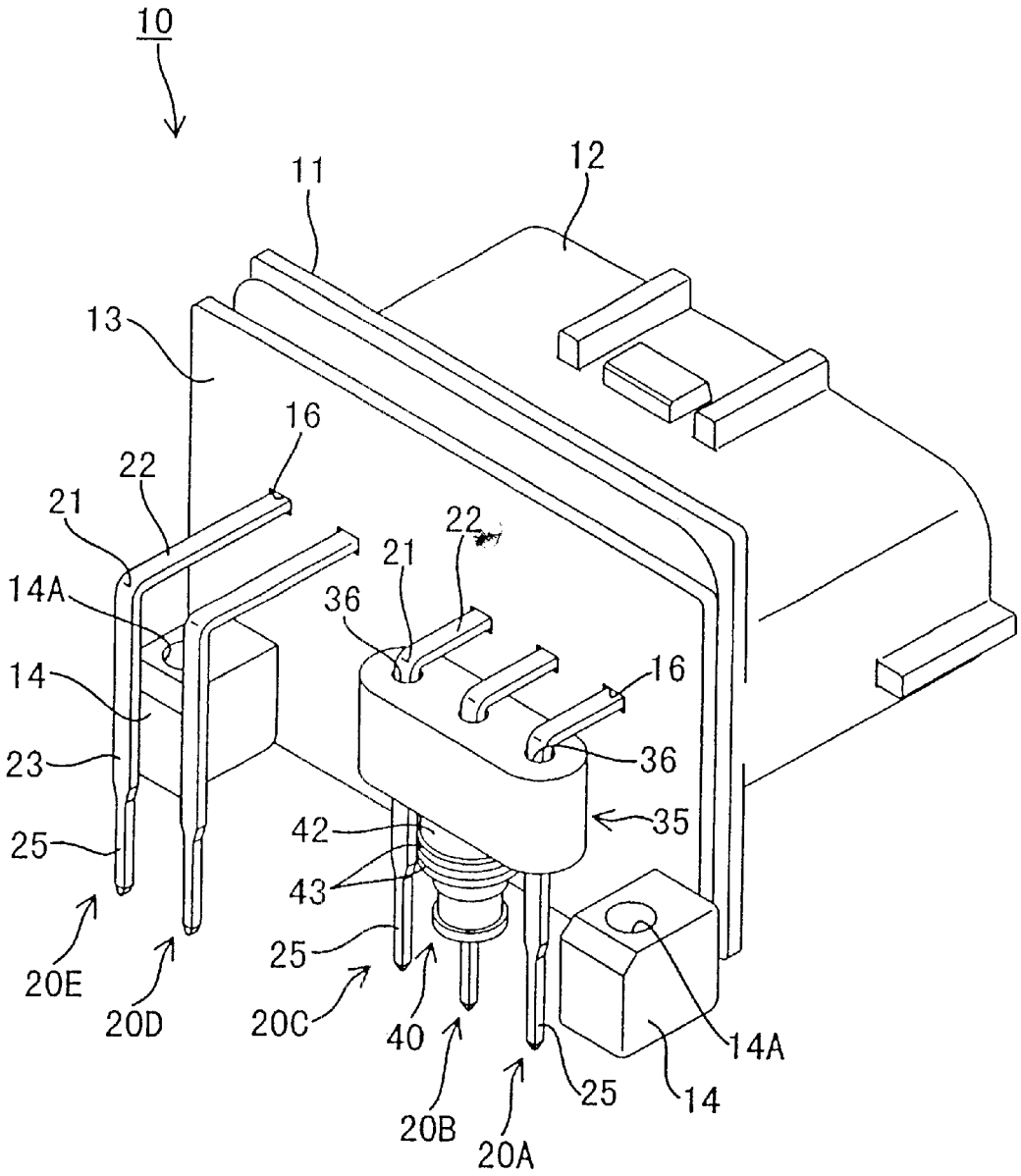
FIG. 4 is a perspective view showing a connector which is another embodiment of the present invention.
Figure 5:
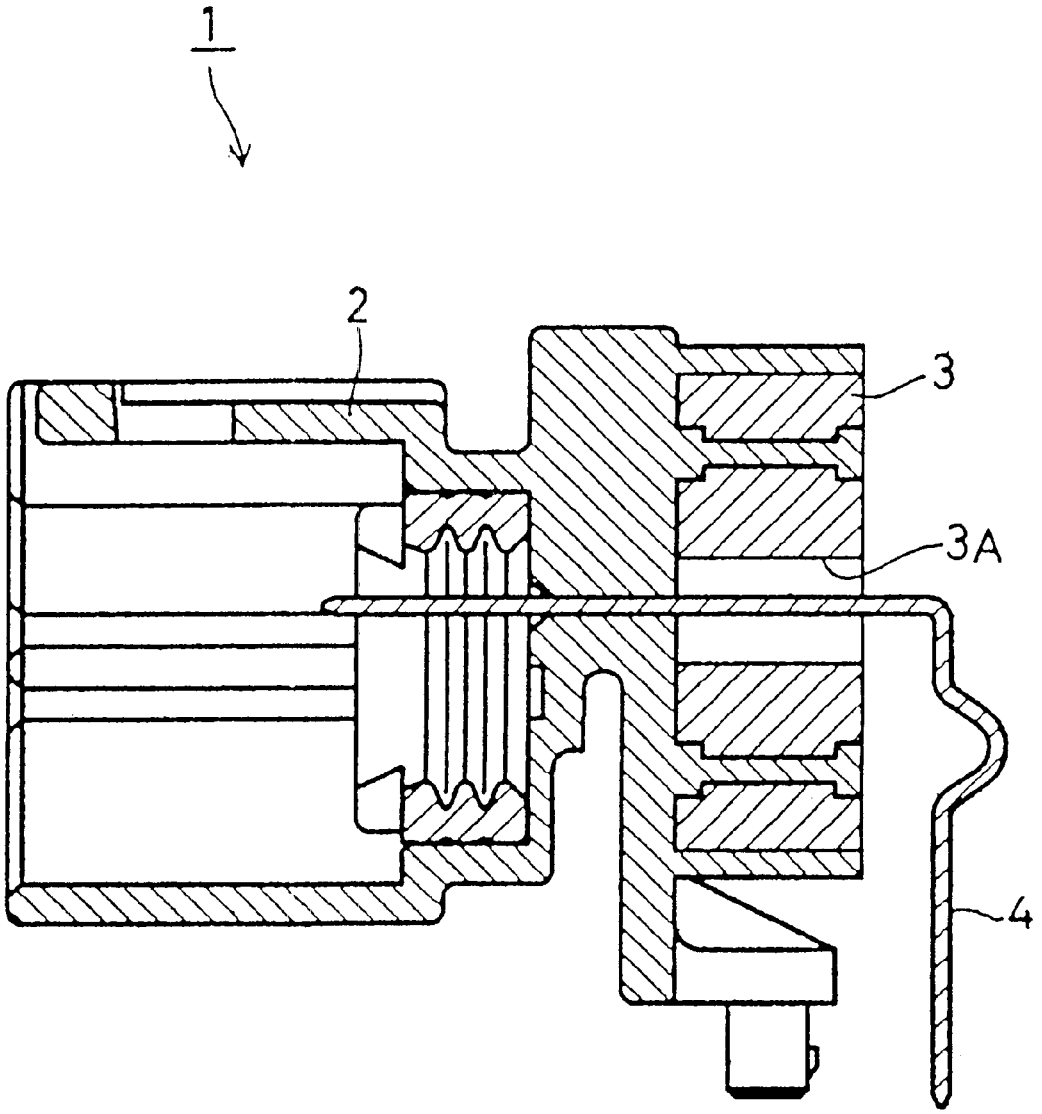
FIG. 5 is a sectional view showing a known electrical connector described above.

(5) The noise-reducing member need not be circularly cylindrical as shown in FIGS. 1 and 2, but may have any other suitable shape, e.g. square cylindrical or cylindrical with a "race track" cross-section as shown in FIG. 4.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. An electrical connector comprising:

a housing;

an electrical terminal fixed in said housing;

an electrical noise-reducing member of magnetic material carried on said terminal and having a through-hole through which said terminal extends, to reduce electrical noise in said terminal; and a stop member secured on a substantial area of said terminal and abutting an end of said noise-reducing member at which said terminal emerges from said through-hole, whereby the stop member impedes the movement of said noise-reducing member along said terminal, said stop member being at least partially of elastically deformable material and being elastically secured to said terminal, wherein said stop member is of rubber.

2. An electrical connector according to claim 1, wherein said noise-reducing member is cylindrical, and said through-hole is parallel to a cylindrical axis thereof.

3. An electrical connector according to claim 1, wherein said stop member has a through-hole with a diameter smaller than the width of said terminal, said stop member being installed by inserting said terminal into said through-hole of the stop member to deform said stop member elastically.

4. An electrical connector according to claim 1, having a plurality of said electrical terminals fixed in said housing, said electrical noise-reducing member having a plurality of through-holes through which said terminals respectively extend, and said stop member being secured on at least one of said terminals so as to impede movement of said noise-reducing member along said terminals.

5. An electrical connector according to claim 1, wherein said electrical terminal has a bend, first and second portions of the terminal joining at said bend, and said noise-reducing member is carried on said first portion and held against movement there along by said stop member and said second portion.

* * * * *